United States Patent [19]
Brorein
[11] 4,253,890
[45] Mar. 3, 1981

[54] FLAME RETARDANT INSIDE WIRING CABLE WITH AN ANNEALED METAL SHEATH

[75] Inventor: William J. Brorein, Whippany, N.J.

[73] Assignee: General Cable Corporation, Greenwich, Conn.

[21] Appl. No.: 959,904

[22] Filed: Nov. 13, 1978

Related U.S. Application Data

[63] Continuation-in-part of Ser. No. 845,874, Oct. 25, 1977, Pat. No. 4,154,976.

[51] Int. Cl.[3] ..... H01B 13/26; H01B 13/06

[52] U.S. Cl. ..... 156/55; 156/56; 156/250; 156/324; 156/304.5; 29/871

[58] Field of Search ..... 156/56, 55, 54, 53, 156/47, 304, 324; 29/624

[56] References Cited

U.S. PATENT DOCUMENTS

| | | | |
|---|---|---|---|
| 3,529,340 | 9/1970 | Polizzano et al. | 29/234 |
| 3,614,299 | 10/1971 | Grail | 156/56 X |
| 3,964,945 | 6/1976 | Everhart et al. | 156/56 X |
| 4,100,002 | 7/1978 | Woytiuk et al. | 156/56 X |
| 4,113,534 | 9/1978 | Pound et al. | 156/56 |
| 4,134,953 | 1/1979 | Dembiak et al. | 156/56 X |

*Primary Examiner*—George F. Lesmes
*Assistant Examiner*—Alexander S. Thomas
*Attorney, Agent, or Firm*—Roy C. Hopgood; John M. Calimafde; Charles W. Neill

[57] ABSTRACT

This specification describes an improved method for making fire-resistant communication cables that have a core which includes a multitude of individual conductors or pairs with insulation surrounding some or all of the conductors. The conductors are enclosed in a metal sheath that has a welded seam and that is annealed to maintain the flexibility of the cable. The sheath is of larger diameter of the core when welded, but is drawn down to a reduced diameter that hugs the core prior to the annealing. Heat insulation is wrapped around the core to protect the insulation on the conductors from the heat that is used to anneal the sheath. The purpose of the construction is to provide indoor cable that does not propagate flames from a burning area in a building into adjacent non-burning areas. The cable sheath is purposely not bonded to the core to facilitate sheath removal for ease of terminating the cable.

9 Claims, 5 Drawing Figures

FLAME RETARDANT INSIDE WIRING CABLE WITH AN ANNEALED METAL SHEATH

PRIOR APPLICATION

This case is a continuation-in-part of my application Ser. No. 845,874, filed Oct. 25, 1977, now U.S. Pat. No. 4,154,976.

PRIOR ART

U.S. patents that seem pertinent to part of this invention are as follows: U.S. Pat. Nos. 3,529,340; 3,567,846; and 3,693,250.

BACKGROUND AND SUMMARY OF THE INVENTION

The object of this invention is to make a more flame-retardant flexible cable for use inside buildings for interconnecting telephone and other low voltage communication or signal circuits.

Basically to accomplish this objective, the usual PVC plastic jacket over the cable core has been replaced with an annealed flexible aluminum or copper tube that is made from a longitudinal strip that is formed into a tube over the core, continuously welded, drawn down snugly onto the core and annealed in a continuous operation.

The cable core, consisting of a number of insulated single or paired conductors, is wrapped with heat barrier tapes to protect the core during manufacture and subsequent use in the field. These tapes may consist of one or more layers of asbestos, paper, fiberglass, heat-resistant plastic or the like; however, paper tapes either helically or longitudinally applied are the most economical at this time; and crepe paper is advantageous for lower heat conduction.

The conductor insulator is a specially formulated semi-rigid PVC that is self-extinguishing and it emits minimum smoke fumes when exposed to fire due to the use of relatively large amounts of inorganic materials in its composition.

Some of the advantages of this invention over conventional polyvinyl chloride plastic jacketed cables are that the non-combustible metal sheath of the invention replaces a plastic jacket which comprises more than half of the combustible material weight in the conventional cable. For example, a popular size of conventional cable containing 25 pairs of No. 24 AWG wire contains 27 lbs. of PVC jacket material per thousand feet and 24 lbs. of PVC conductor insulation. Also, the non-combustible metal sheath greatly reduces flame spread in the event of a fire and also prevents afterburn in the cable of the present invention.

Elaborate tests prescribed by the Underwriters Laboratories* showed that aluminum sheathed cables of this invention had negligible flame travel or spread beyond the point of direct flame application, while all comparable plastic sheathed cables had flame spread the entire length of the cable in vertical flame tests and for 10 to 15 feet in horizontal flame tests.

*U.L. 1277; ASTM-E 84 (modified for cable)

It was also discovered that the intermixing of aluminum sheath cables among plastic sheath cables, which might be cables already installed, had the effect of reducing flame spread among all of the cables, as was demonstrated by tests. The metal sheath is easily removed from the core to facilitate terminating the cable.

A still further advantage is that the lightweight flexible annealed aluminum sheath cables are easy to install and such an installation is far more economical than placing plastic sheath cables in metal conduits.

Other objects, features and advantages of the invention will appear or be pointed out as the description proceeds.

BRIEF DESCRIPTION OF DRAWINGS

In the drawing, forming a part hereof, in which like reference characters indicate corresponding parts in all the views:

FIGS. 4 and 5 are diagrammatic views showing the removal of the sheath to facilitate splicing.

DESCRIPTION OF PREFERRED EMBODIMENT

Figure 1:
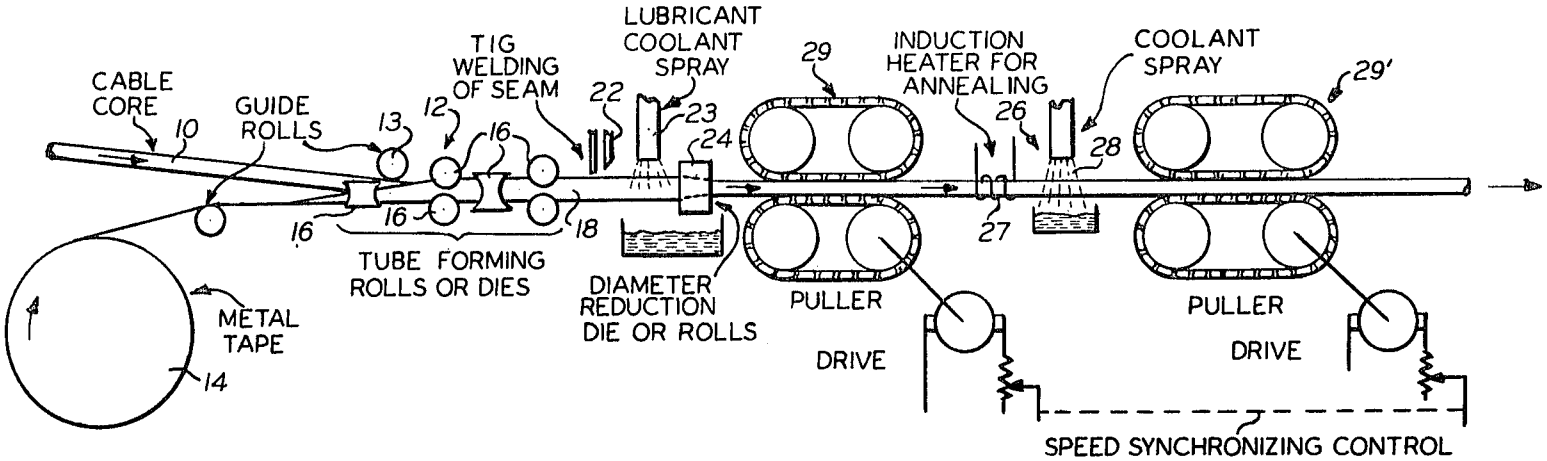
FIG. 1 is a diagrammatic showing of apparatus for making cable by the method of this invention.
Figure 3:
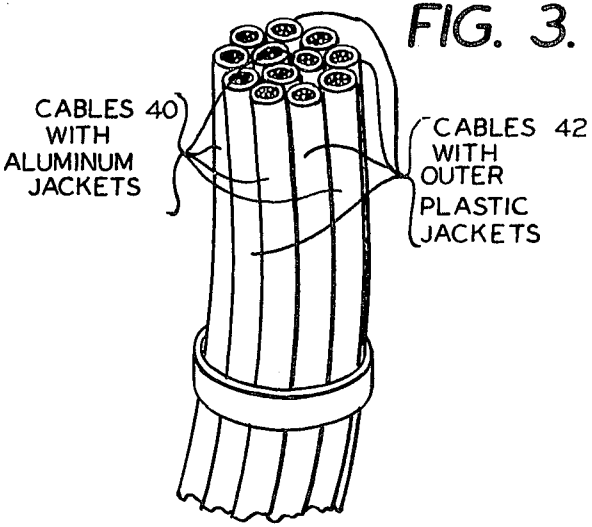
FIG. 3 is a diagrammatic showing of an intermixture of cables having outer plastic jackets and aluminum sheaths.

FIG. 1 is a diagrammatic showing of one way in which the metal sheath inside wiring cable of this invention can be made. A cable core 10 is guided to a cladding station 12 by rollers 13. Metal tape is withdrawn from a roll 14 of such tape and is advanced through forming rolls 16 of the cladding station 12 where it is longitudinally folded around the cable core with the inside diameter of the tubular sheath somewhat larger than the outside diameter of the cable core 10. The sheath, as it comes from the cladding station 12, is indicated by the reference character 18 in FIG. 1.

The manufacture of the cable core 10 may be by conventional means, and the construction of the core will be described in connection with FIG. 2.

The edges of the metal sheath are held in abutting relation by guiding rollers 16 or forming dies with the longitudinal abutting edges of the metal in contact with one another as they pass through a welding station 22 which welds the abutting edges of the seam together. Welding by the tungsten insert gas (TIF) process is typical.

The larger diameter of the sheath 18 provides spacing of the seam from the core, which protects the core from damage by the welding heat; and the heat in the seam is dissipated rapidly by a lubricant spray 23 and by conduction into the cooler portions of the sheath 18. The sheath 18 then passes through a reducing die 24 or rolls which reduces the diameter of the sheath so that its inside diameter is substantially equal to the outside diameter of the core 10, and the metal provides a continuous fire-retardant protective jacket around the core.

Beyond the reducing die 24, the sheathed cable passes through an annealing zone 26 which supplies sufficient heat, by induction coil 27, to anneal the metal, followed by cooling sprays 28 to quickly quench the metal of the sheath. The cable is advanced through the successive operating stations by one or more pullers, which are shown diagrammatically in FIG. 1 and indicated by the reference characters 29 and 29'.

Figure 2:
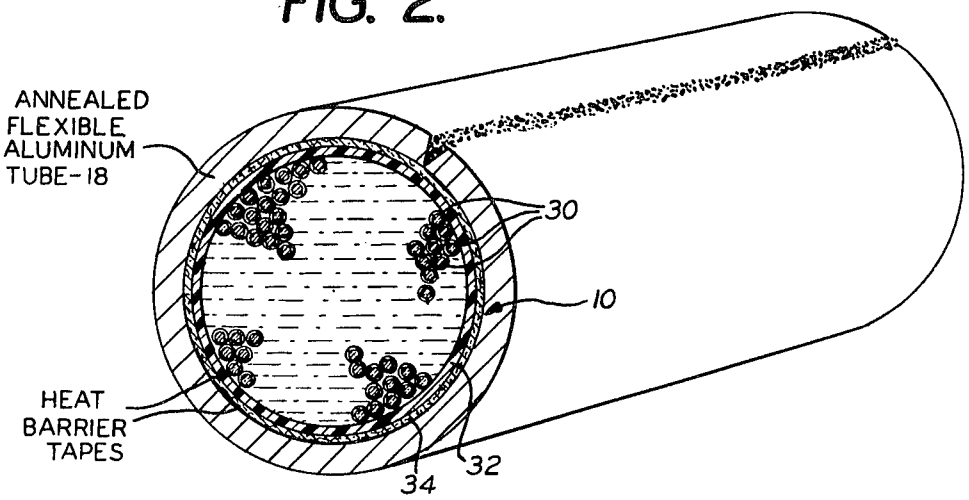
FIG. 2 is a sectional view of a flame-retardant inside wiring cable made by the method of this invention.

FIG. 2 shows the cable core 10 formed with a plurality of conductors 30, each of which is surrounded by a layer of insulation, preferably a semi-rigid polyvinyl chloride insulation. The insulation on the conductors 30 preferably contains some 5 to 40 parts of inorganic filler material including antimony trioxide. A typical formulation would be:

PVC resin: 100 parts
Plasticizer: 20 to 40 parts
Filler: 5 to 40 parts
Stabilizers & Lubricants: 1 to 10 parts The conductors 30 are approximately 0.015 to 0.020 inches with insulation thereon of approximately 0.007 to 0.010 inches.

One or more layers of heat-resistant material is applied over the conductors 30 to complete the construction of the cable core 10. FIG. 2 shows two such layers, including an inner layer 32 and an outer layer 34. These layers are preferably tapes applied either helically or longitudinally and they can be made of heat-resistant material such as asbestos, paper, fiberglass, or heat-resistant plastic. Where more than one layer is used, they can be made of different kinds of material from one another. Ordinary kraft paper is quite suitable, but crepe paper can be used for greater heat insulation of the core. Foam heat-resistant plastic tapes, rubber tapes, rubber polyester laminated tapes, or silicone rubber are desirable where high dielectric strength is needed between the sheath and the cable core. Intumescent tapes, such as made by Avco Systems and others are useful for delaying damage to the core and to prolong the cable integrity when exposed to flame.

The expression "heat-resistant plastic" is used herein to designate plastic that does not melt and stick to adjacent material such as the sheath 18, when exposed to the heat used to anneal the sheat 18 at the annealing zone 26.

For minimum fuel contribution, where the cable may be melted and entirely destroyed by flames, fiberglass and asbestos tapes are most desirable.

Where paper tapes are used, each layer may be 0.005" thick, while rubber laminated with polyester (polyethylene terephthalate) may be 0.015" thick. These are preferred dimensions, and it will be understood that the thickness of the heat-insulating tapes and the combinations of different materials that may be used will depend upon the amount of heat insulation desired and other cable requirements.

The thickness of the metal tape 14 when aluminum is used depends upon the size of the cable. Experience has shown that a wall thickness of an aluminum sheath of about 0.020 inches or less is satisfactory for a 0.250" O.D. cable; and that this thickness should be increased to about 0.040" for a 0.750" O.D. cable. These values are given by way of illustration.

While aluminum is the preferred material for the metal sheath of this invention, other metals can be used such as copper.

FIG. 4 shows the cable 10 with the tube 18 in contact with heat barrier tapes 32 and 34 with the inner taper 32 in contact with the conductors 30 of the core and with the outer tape 34 supported by the inner tape 32. The outer surface of the tape 34 contacts with the inside surface of the sheath 18 but is not adhered thereto.

FIG. 4 shows an end 40 at which the core 10 and the metal sheath 18 both terminate. In order to continue the circuits of the conductors 30, it is necessary to splice the respective conductors 30 to corresponding, similarly color-coded conductors of another length of cable or to connect them to a connector, terminal strip or piece of apparatus.

In order to make such connections, it is necessary to remove the metal sheath 18; and with the construction of this invention, the sheath 18 can be easily and quickly removed from the end portion of the cable without risk of damaging the insulation of any of the conductors 30. A tool 42, having a handle 44, is used to form a circumferential score 46 in the sheath 18. This circumferential scroe 46 preferably extends only part way through the sheath 18, and the sheath can be easily broken at the score 46 by flexing the cable slightly first one way and then the other.

When the cable sheath 18 is severed at the score or indentation 46, the length of sheath beyond the score 46 can be displaced toward the right in FIG. 4, as indicated by the reference character 18 with the dotted leader line. This is easily done by holding the sheath 18 at opposite sides of the score at 46 and sliding the portion of the sheath to the right of score 46 until it is completely clear of the end portion of the cable.

The sheath 18 is drawn down over the cable core in the die 24 (FIG. 1), but the draw down causes the sheath to hug the core without setting up sufficient pressure to cause excessive friction to movement of the severed end of the sheath, as illustrated in FIG. 4. Also, the tape 34, which contacts with the sheath, has a low friction surface to facilitate the sliding off of the end of the sheath from the core of the cable.

FIG. 5 is a view similar to FIG. 4, but with only the sheath 18 shown in section. The tapes 32 and 34 are not cut off by the tool 42, and it is preferable that they should not be, because if the tool 42 cut through the tapes, it might also damage the insulation on the conductors 30. Also, if the break in the sheath at the depression 46 leaves a rough inner edge on the cut-off portion of the sheath, the tapes 32 and 34 will protect the insulated conductors of the core from damage by the rough edge as the end of the sheath is moved longitudinally to the right in FIGS. 4 and 5 to completely remove it from the cable.

While the tapes 32 and 34 may be unwound and torn off at the shoulder 46', it is preferable to apply a layer of adhesive tape 48 over tapes 32 and 34 adjacent to the shoulder 46' to protect the conductors from the possibility of damage from the sheath edge 46'. The insulated conductors 30 can be spread, as indicated in FIG. 5; and they can be connected to connectors, terminal strips or the next length of cable from which the sheath has been removed in the same manner as described in FIG. 4.

The purpose of this invention is to provide a cable of moderate cost that is easy to install and connect; and which contributes, when exposed to flames from external sources, a minimum of smoke and fuel to the existing flames, and which does not spread the flames from one area to another.

The preferred embodiment of the invention has been illustrated and described, but changes and modifications can be made and some features can be used in different combinations without departing from the invention as defined in the claims.

What is claimed is:

1. The method of making a communication cable from a multitude of similar individual pre-insulated conductors, and with the conductors brought together to form a core surrounded by heat-insulating tapes which method comprises advancing the cable core, folding around the advancing core a metal sheath of greater inside diameter than the outside diameter of the multi-conductor core, welding together the edge portions of a seam of the sheath, drawing the welded sheath down to a snug fit around the multi-conductor core, annealing the metal of the sheath to increase the flexibility of the cable, and protecting the insulation on the conductors of the core that are near the periphery of the core by using the layer of tape as a heat barrier to provide protection from the heat that anneals the metal sheath by making the layer of tape of a material that does not melt or burn when exposed to the annealing heat that flows through the metal shield during the annealing operation, and making the heat barrier layer of a thickness much less than the radius of the core, and crowding the insulated conductors together in contact with one another in the core, and leaving the sheath as the outside surface of the cable for fire protection, and free to slide longitudinally on the surface of the core when the sheath is severed circumferentially at a location longitudinally spaced back from an end of the cable to expose the conductors of the core for making electrical and mechanical connections.

2. The method described in claim 1 characterized by the insulation on the insulated conductors of the core being color coded, and the heat barrier layer that encloses the core being made of paper which confronts the sheath and which is free of any surface-to-surface connection with the sheath.

3. The method described in claim 1 characterized by applying a plurality of layers of tape to enclose the core, and superimposing one tape upon an underlying tape with the outer tape free of any surface-to-surface connection with the sheath.

4. The method described in claim 1 characterized by supplying tape between the core and the metal sheath, with the surface of the tape free to slide with respect to the sheath both before and after being subjected to the heat that anneals the metal of the sheath.

5. The method described in claim 1 characterized by forming the metal sheath preparing one end of the cable for splicing by cutting part way through the metal sheath circumferentially at a location spaced back from an end of the cable, breaking off the sheath at the cut, sliding the severed sheath longitudinally over the end of the cable while the tape that surrounds the conductors of the core protects the insulated conductors from damage by contact with the severed edge of the sheath as the sheath slides from the region of severance to the ends of the insulated conductors, and removing the tape, after removal of the sheath, to expose the conductors of the core for making electrical and mechanical connections.

6. The method described in claim 1 characterized by making the conductors of the cable core of wires of approximately 0.015 to 0.020 inches and with insulation thereon having a thickness of approximately 0.007 to 0.010 inches.

7. The method described in claim 1 characterized by making the conductors of the core of metal wires having insulation thereon and a thickness less than the diameter of the wires to which the insulation is applied.

8. The method described in claim 1 characterized by advancing the cable core with continuous motion, applying the sheath to the core while the core advances, and with the sheath formed into a tube around the core and of substantially larger inside diameter than the outside diameter of the core, welding a seam of the sheath as it advances with the core, passing the sheath through apparatus that reduces the diameter of the sheath to a size that hugs the core, and with the sheath in contact with the circumference of the core, heating the sheath to a temperature high enough to anneal the sheath, and cooling the sheath before the annealing heat damages the sheath and the conductors near the outside of the core.

9. The method described in claim 1 characterized by making the tape heat barrier of material from the group consisting of asbestos, paper, fiberglass, rubber, solid and foamed plastics.

* * * * *